US006715537B1

(12) United States Patent
Grothe

(10) Patent No.: US 6,715,537 B1
(45) Date of Patent: Apr. 6, 2004

(54) DEVICE FOR THE CONTINUOUS CASTING OF METAL

(75) Inventor: Horst Grothe, Kaarst (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/069,707

(22) PCT Filed: Aug. 11, 2000

(86) PCT No.: PCT/EP00/07857

§ 371 (c)(1),
(2), (4) Date: Feb. 26, 2002

(87) PCT Pub. No.: WO01/15834

PCT Pub. Date: Mar. 8, 2001

(30) Foreign Application Priority Data

Aug. 28, 1999 (DE) ..... 199 40 997

(51) Int. Cl.[7] ..... B22D 11/053; B22D 27/08
(52) U.S. Cl. ..... 164/416; 164/478; 164/71.1
(58) Field of Search ..... 164/416, 478, 164/71.1

(56) References Cited

U.S. PATENT DOCUMENTS 5,201,909 A * 4/1993 Von Wyl et al. ..... 164/416
5,623,983 A * 4/1997 Thone et al. ..... 164/416
5,642,769 A * 7/1997 Thone et al. ..... 164/416
5,715,888 A 2/1998 Kaell et al.
6,079,478 A * 6/2000 Grothe ..... 164/416
6,138,743 A * 10/2000 Zajber et al. ..... 164/416
6,167,941 B1 * 1/2001 Schallenberg ..... 164/416

FOREIGN PATENT DOCUMENTS

| | | |
|---|---|---|
| CH | 358902 | 3/1957 |
| CH | 377053 | 12/1964 |
| EP | 0150357 | 8/1985 |

* cited by examiner

*Primary Examiner*—M. Alexandra Elve
(74) *Attorney, Agent, or Firm*—Friedrich Kueffner

(57) ABSTRACT

A device for the continuous casting of metal includes a lifting platform which can be driven in an oscillating fashion by a drive device, a continuous casting mold received on the lifting platform, and a stationarily arranged support frame provided with guiding or bearing elements for the lifting platform. The guiding or bearing element is an elastic spring system including two spring legs arranged angularly relative to one another and extending perpendicularly to the oscillation direction. The two spring legs are formed like a tuning fork and respectively overlapping upper and lower ends of the two spring legs form the support surface for the lifting platform or the connecting surface with the stationarily arranged support frame. The spring system, in addition to the force in the oscillation direction, compensates by load balancing disturbing forces in directions perpendicular to the oscillation direction.

6 Claims, 6 Drawing Sheets

DEVICE FOR THE CONTINUOUS CASTING OF METAL

BACKGROUND OF THE INVENTION

1. Field of the Invention

The invention relates to a device for the continuous casting of metal, in particular, steel, comprising a lifting platform which can be driven by means of a drive device so as to oscillate, further comprising a continuous casting mold received on the lifting platform, as well as a stationary support frame which is provided with guiding or bearing elements for the lifting platform.

2. Description of the Related Art

It is known to subject a casting mold to an oscillating movement in order to assist a continuous casting process during continuous casting. Conventionally, continuous casting molds are received on lifting platforms which transmit this oscillating movement onto the mold while they themselves are provided with drive means. This lifting platform is received on a base frame or support frame and is supported therein by means of roller bearings or slide bearings.

As a substitute for roller bearings and slide bearings spring systems are known, for example, from EP 0 150 357 B1. A guide device is described herein for a continuous casting mold wherein holders are fastened on a unitary mold lifting platform, wherein each holder is connected by means of a spring element with a changing frame positioned on the base frame. These holders are comprised of a spring support which receives a straight leaf spring on which an intermediate piece, connected to the mold lifting platform, is centrally positioned.

SUMMARY OF THE INVENTION

It is an object of the invention to provide a device for the continuous casting of metal, in particular, steel, with guide elements between the lifting platform and a stationarily arranged support frame, which guide elements are simple, wear-resistant, and maintenance-free and ensure a precise guiding of the lifting platform independent of thermal expansions.

The gist of the invention resides in the embodiment of the guide element as a load balancing system which, in addition to receiving the load in the oscillation direction, also receive the loads in the directions perpendicular thereto. A first load balancing system is formed as an elastic spring system. It is comprised of two spring legs, arranged angularly relative to one another, preferably at an angle of 90°, which extend perpendicularly to the oscillation direction, respectively, wherein the two spring legs are formed like a tuning fork and wherein the overlapping upper and lower ends of the two spring legs, respectively, form the support surface for the lifting platform or the connecting surface with the stationarily arranged support frame and wherein the spring system receives forces in both directions perpendicular to the oscillation direction, in addition to the force in the oscillation direction A second conceivable load balancing system is suggested in the form of a pressure-controlled cushion system which is operated with a corresponding medium, preferably air or a corresponding liquid.

Overall, in contrast to the known roller bearings and slide bearings, a maintenance-free support action of the oscillating lifting platform on a support frame is ensured, in particular, by means of the spring system. The guide action is without play because, aside from the elastic deformation of the springs, no change of the movement geometry takes place.

According to a first embodiment, the two tuning fork-shaped legs of the spring system are a unitary part and, according to a second embodiment, they are of a two-part configuration. A first outer part is connected with the lifting platform, a second outer part with the support frame. The spring system can be adjusted by movement of the two lower leg parts. By means of different dimensions of the leaf springs which form the tuning fork with respect to their length, width, and thickness, the spring action and the movement precision can moreover be adjusted to various applications.

BRIEF DESCRIPTION OF THE DRAWINGS

Further details and advantages of the invention result from the claims and the following description. In this connection it is shown in:

DETAILED DESCRIPTION OF TEE PREFERRED EMBODIMENTS

Figure 1:
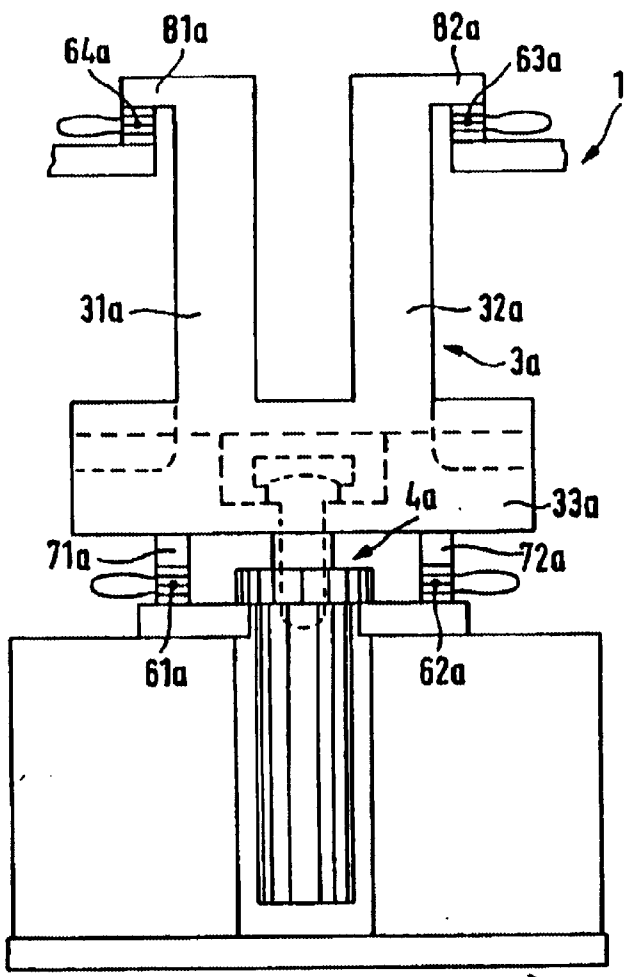
FIG. 1 a schematic side view of the continuous casting device with lifting platform and support frame.

The continuous casting device 1 according to FIG. 1 is comprised of a two-part support frame 2*a*, 2*b* with a two-part lifting platform 3*a*, 3*b*, wherein the lifting platform receives the casting mold (not shown), for example, a mold for casting thin slab. As a result of the side view being shown, only the support frame element 2*a* and the lifting platform element 3*a* are visible. A lifting platform element has an L-shaped basic form (see FIG. 3) and is comprised of two parts 31*a*, 32*a* symmetrical tot he longitudinal axis. The lifting platform element 3*a* is supported on a stationary support frame element 2*a*. It receives a lifting cylinder 4*a* whose plunger 5*a* is anchored in the foot area 33*a* of the lifting table 3*a*. The lifting platform element 3*a* and thus the mold are subjected to an oscillating movement.

By means of guide elements in the form of a spring systems 61*a*, 62*a*, 63*a*, 64*a* the lifting platform element 3*a* is supported on corresponding parts of the support frame 2*a*. In the foot area of the lifting platform element 33*a* two cubes 71*a*, 72*a* are fastened which provide the connection between the lifting platform element and the spring systems 61*a*, 62*a*. On the other side, spring systems 63*a*, 64*a* are also connected to the support frame 2*a*. For this purpose, the head area of the lifting platform element is provided with two projections 81*a*, 82*a* which rest on the spring systems 64*a*, 63*a*. The spring systems 64*a*, 63*a* are supported on parts of the support frame 2*a* whose configuration is not illustrated in detail in this connection.

The individual spring systems 61*a* to 64*a* are each comprised of two spring legs which are arranged at a right angle to one another. In the viewing direction of the side view, the spring leg is therefore illustrated only as a point. A spring leg, respectively, is shaped corresponding to the basic form of a tuning fork. For describing the spring system, reference is being had to the detail illustrations of FIGS. 5–10.

Figure 2:
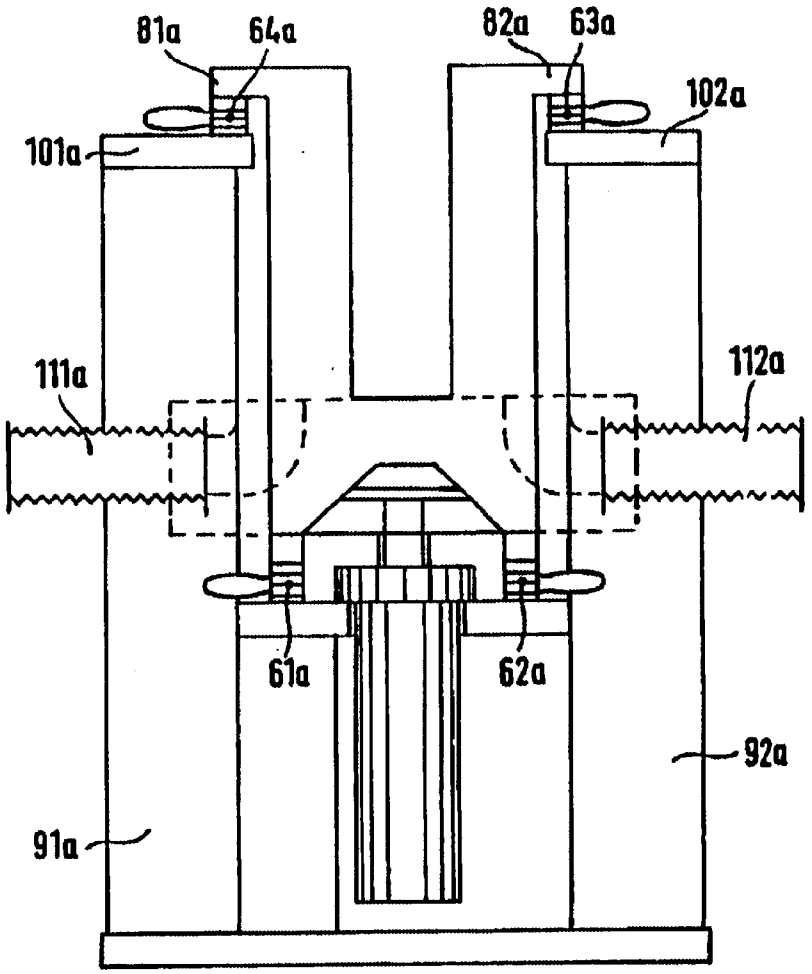
FIG. 2 a schematic side view of the continuous casting device with lifting platform and support frame with guide columns.

FIG. 2 shows in a side view the guide and support columns 91*a*, 92*a*, not illustrated in FIG. 1, whose surfaces 101*a*, 102*a* at the head end are provided for a balancing support of the two projections 81*a*, 82*a* of the lifting platform element by means of the spring systems 64*a*, 63*a*. The configuration height of the guide columns 91*a*, 92*a* is determined by the height of the lifting cylinder 4*a* and by the height of the mold, respectively. Reference numerals 111*a*, 112*a* identify supply inlets for the cooling water of the mold.

Figure 3:
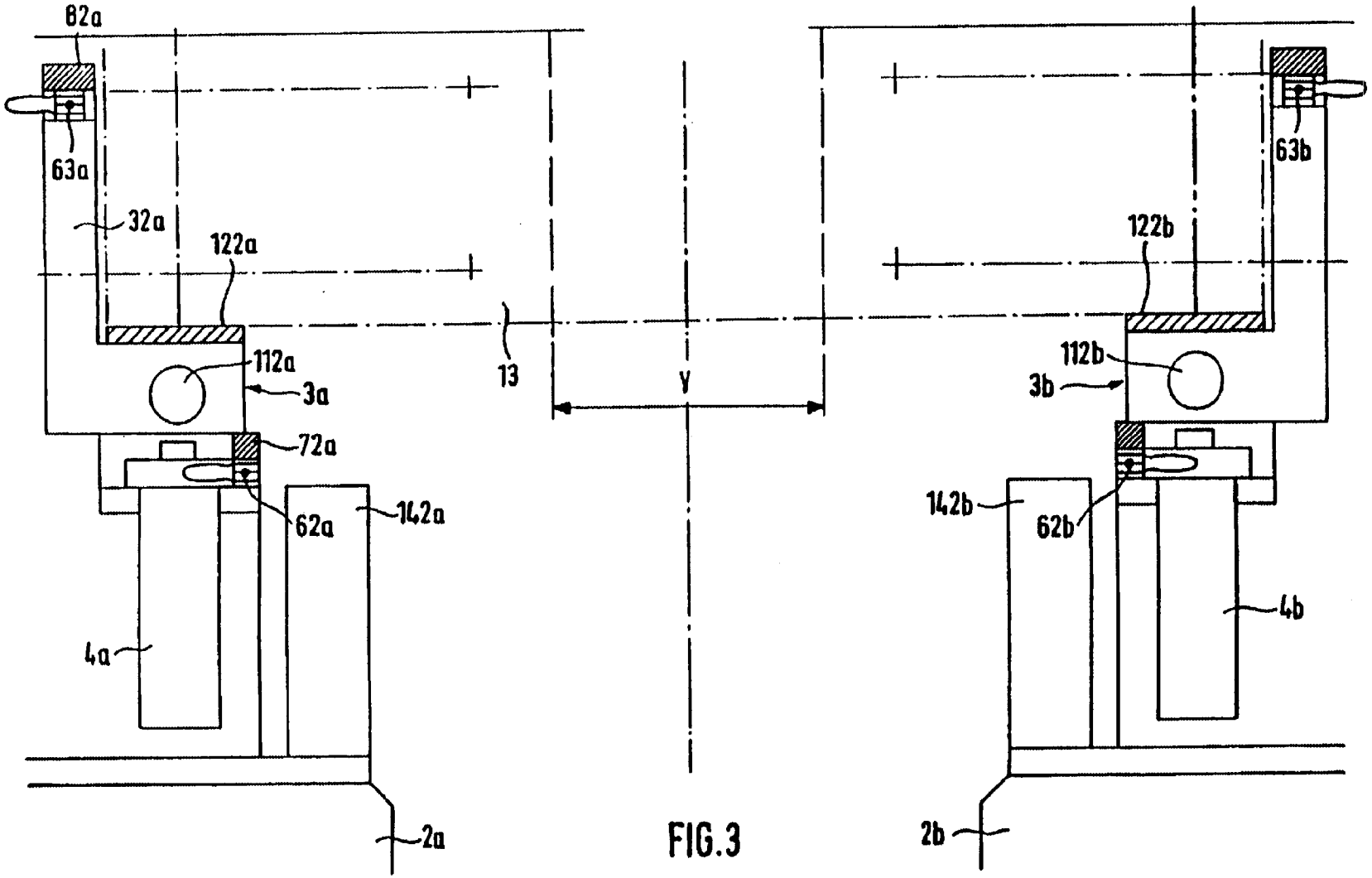
FIG. 3 a front view of the continuous casting device with mold, lifting platform, and support frame.

FIG. 3 illustrates a side view of the continuous casting device which is rotated by 90° relative to the side views of FIGS. 1 and 2. The two support frame elements 2*a*, 2*b* receive each a cylinder 4*a*, 4*b*. First and second L-shaped lifting platform elements 3*a*, 3*b* are arranged opposite one another and at a spacing to one another and receive on corresponding support surfaces 122*a*, 122*b* the mold 13 with the casting width Y. Underneath the exit of the mold, the first segments 142*a*, 142*b* are illustrated, i.e., the first rollers for guiding the strand with solidified shell after exiting from the mold. The two lifting platform elements 3*a*, 3*b* are supported and guided in an oscillating way by means of the spring systems 62*a*, 63*a*, 62*b*, 63*b* on or at the support frame elements 2*a*, 2*b*, wherein the upper part of the support frame element is not illustrated.

Each lifting platform element 3*a*, 3*b* is supported and guided by a total of four spring systems, wherein the upper ones (63*a*, 64*a*, 63*b*, 64*b*) are arranged staggered relative to the lower spring systems (61*a*, 62*a*, 61*b*, 62*b*). Overall, this results in an optimally balanced bearing and guiding system. It is not only possible to receive forces in the oscillation direction but also in the directions perpendicular thereto. A movement of one spring system is compensated immediately by the three other spring systems in the same horizontal plane or by the spring system which are arranged vertically staggered thereto. After experiencing an external force action, the total system will therefore always oscillate back automatically into the initial position.

Figure 4:
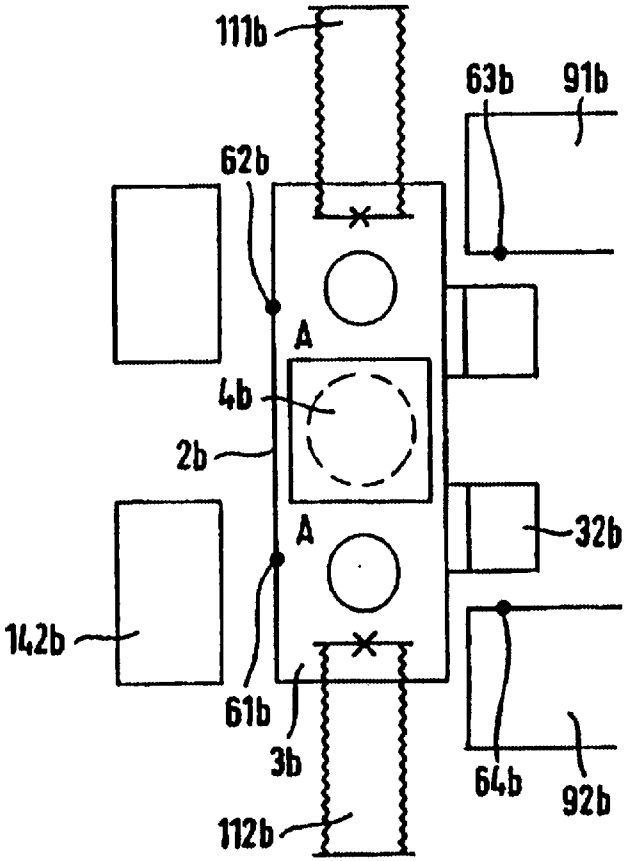
FIG. 4 a plan view of the continuous casting device.
Figure 4:
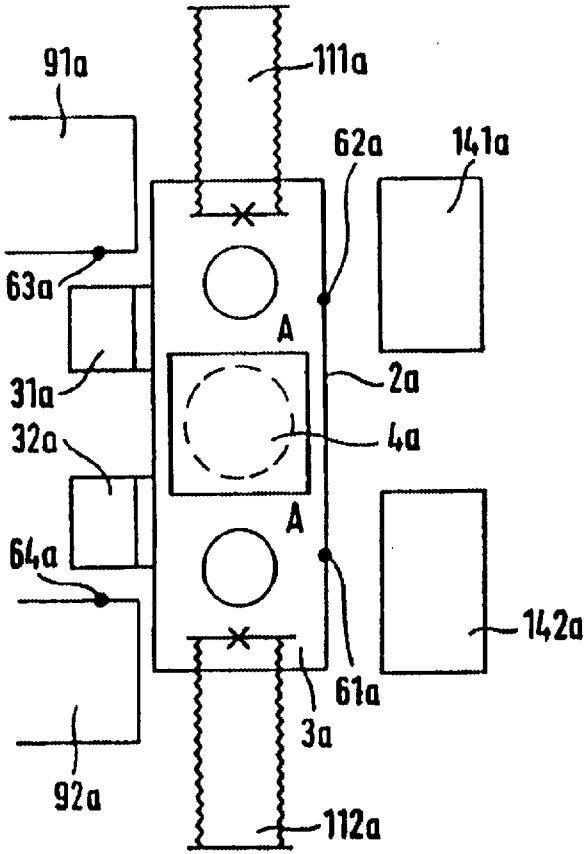

The plan view according to FIG. 4 illustrates the staggered arrangement of the individual spring systems 61*a*, 62*a* relative to 63*a*, 64*a* as well as 61*b* to 64*b* on the opposite side for supporting a lifting platform element. The respective lifting platform element 3*a*, 3*b* is supported and guided by the support frame 2*a*, 2*b* as well as the guide columns 91*a*, 92*a* and 91*b*, 92*b* of the support frame. The support surfaces of the mold on the lifting platform are identified with the letter A. The respective lifting cylinder 4*a*, 4*b* extends centrally relative to the lifting platform element. Laterally thereto, the supply inlets 11*a*, 112*a*, 111*b*, 112*b* for the cooling medium for cooling the wide side of the mold are provided.

If needed, the number of guide elements in the form of spring systems can be increased for an optimal load balancing action. The arrangement of two additional spring systems for each lifting platform element is identified by the letter X.

Figure 5:
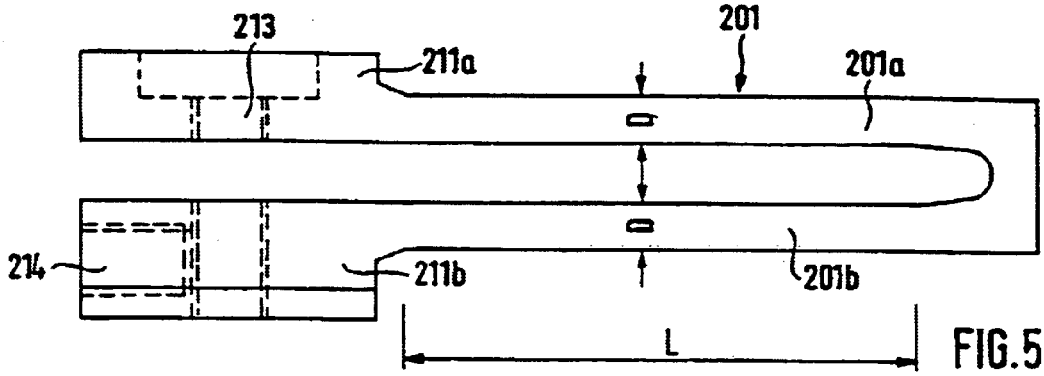
FIG. 5 a side view of a unitary spring system.
Figure 6:
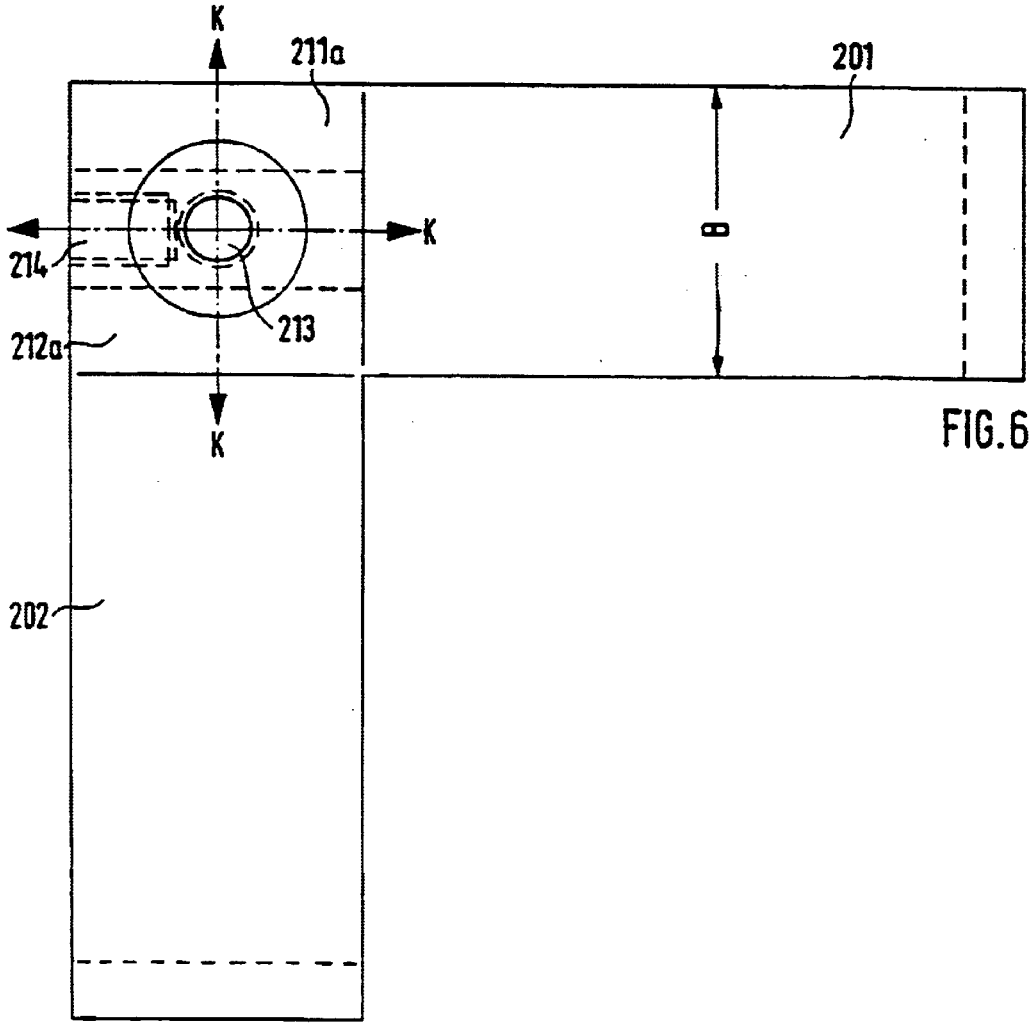
FIG. 6 a plan view onto the spring system of FIG. 5.

FIGS. 5 and 6 show a side view as well as a plan view of a monolithic spring systems in detail. A spring system is comprised of two spring legs 201 and 202 which are arranged at a right angle to one another. In this embodiment, one spring leg 201, 202, respectively, is formed by a unitary U-shaped leaf spring which thus forms an upper part 201*a*, and a lower part 201*b* , While the width B of the leaf spring has a smaller effect on the properties of the entire system, the length L and the thickness D of the individual leaf spring or the tine of the formed tuning fork have a greater influence on the properties of the total spring system. When using a casting mold for thin slab, the following dimensions are recommended for the spring system: width B=100 mm; length L more than 200 mm; thickness D approximately 12 for 14 mm. The spacing between the upper and the lower spring parts 201*a*, 201*b* in the unloaded state is 20 mm ±5 mm. The spring material is preferably stainless spring steel.

The end pieces 211*a*, 211*b*, 212*a* of the upper or lower part of the spring leg, which in this embodiment are monolithic, serve as support surfaces for the respective lifting platform element or connecting surface with the support frame.

A bore 213 is introduced into the end pieces of the spring legs for receiving a screw connection with countersunk screw head which ensures a detachable connection of the spring system with the lifting platform side. The lower ends of the spring legs (201*b*, 202*b* (not shown)) are changeable with respect to their position and adjustable. For this purpose, a bore 214 is provided within the end pieces 211*b*, 212*b* (not shown) of these parts. The adjustment is realized by a mutual effect of the screw bolts. The arrows shown in FIG. 6 illustrate that the disturbing forces K occurring perpendicularly to the oscillation direction can be compensated by the suggested spring system.

Figure 7:
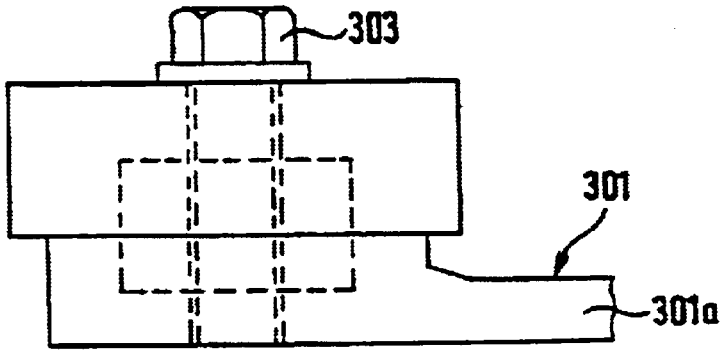
FIG. 7 a side view of a two-part spring system.
Figure 8:
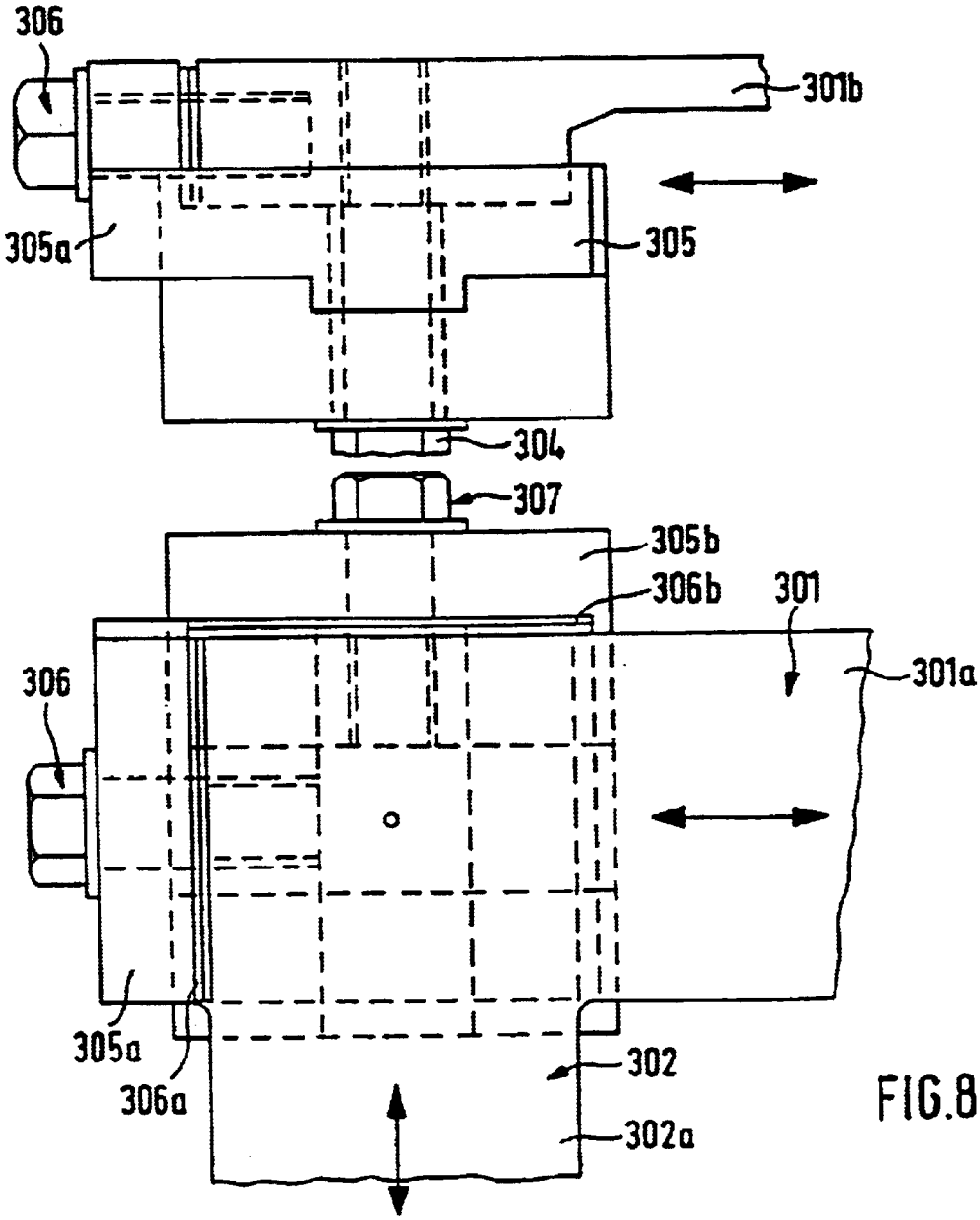
FIG. 8 a plan view onto the spring system according to FIG. 7.

In comparison to this, FIGS. 7 and 8 show the side view and plan view of the two-part embodiment of the spring system. The end pieces of the two spring legs are connected by a screw connection to one another. The first spring leg 301 (not completely illustrated here) is comprised of an upper and lower part 301*a*, 301*b*. At a right angle to this leg 301 the two parts 302*a*, of the second spring leg 302 are arranged. By means of the screw connection 303 which extends to the bottom of the part 301*a*, the end pieces of the spring legs are connected to one another. In an analog fashion, the lower parts of the two spring legs 301*b* and 302*b* are connected with one another by a screw connection 304. In addition, a slide 305 between the parts 301*b* and 302*b* is provided whose one side surface 305*a* can be screwed down by an additional screw connection 306 against the end piece of the lower part 301*b*. Overall, the lower part of the spring system is thus adjustable in the direction illustrated by the arrow.

The plan view of FIG. 8 illustrates that at the lower area of the spring system an adjustment of the spring system in two directions, indicated by the arrows, is possible by means of the two adjusting screws 306 and 307. The two parts of the intermediate slide 305*a*, 305*b* rest by means of fitting sheet metal panels 306*a*, 306*b* on the corresponding end pieces. Overall, with this embodiment with the above mentioned concrete dimensions of a length of 200 to 220 mm and a thickness of 12 or 14mm, a stroke of ±5 mm can be compensated. The adjusting stroke on the adjusting side is also ±5 mm.

Figure 9:
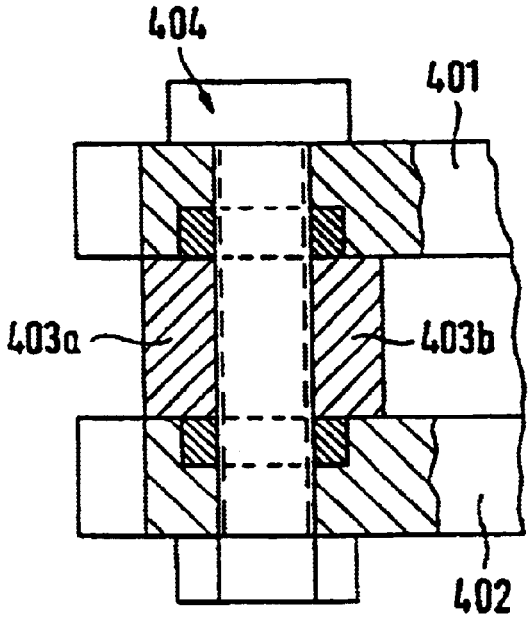
FIG. 9 a first embodiment of a two-part spring leg configuration of a spring system.
Figure 10:
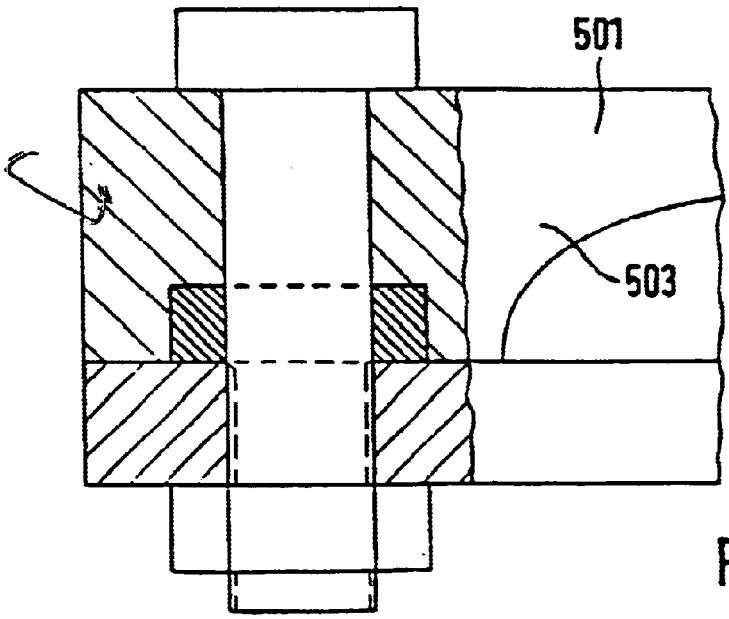
FIG. 10 a second embodiment of a two-part spring leg configuration of a spring system.

FIG. 9 shows an embodiment of the spring leg of a spring system wherein the spring leg is not a bent spring but is comprised of two spring elements. The two spring elements 401 and 402 are spaced apart from one another by means of spacer members 403*a*, 403*b* and are detachably connected to one another by a screw connection 404. According to a second embodiment (FIG. 10) the spacer members can be eliminated in that already the upper spring element 501 is formed as a unitary part with a corresponding bridge element 503. A detachable connection is again realized by means of a screw connection.

What is claimed is:

1. A device for the continuous casting of metal, in particular, steel, comprising a lifting platform which can be driven in an oscillating fashion by means of a drive device, further comprising a continuous casting mold received on the lifting platform, as well as a stationarily arranged support frame which is provided with guiding or bearing elements for the lifting platform, wherein such a guiding or bearing element is an elastic spring system (61*a* to 64*a*, 61*b* to 64*b*), comprised of two spring legs (201, 202; 301, 302) arranged angularly relative to one another, which spring legs extend perpendicularly to the oscillation direction, respectively, wherein the two spring legs are formed like a tuning fork and wherein respectively overlapping upper and lower ends (211*a*, 211*b*, 212*a*, 212*b*; 311*a*, 311*b*, 312*a*, 312*b*) of the two spring legs form the support surface for the lifting platform (3*a*, 3*b*) or the connecting surface with the stationarily arranged support frame (2*a*, 2*b*), and wherein the spring system, in addition to the force in the oscillation direction, compensates by load balancing disturbing forces in directions perpendicular to the oscillation direction.

2. The device according to claim 1, wherein the spring system of the two spring legs is formed of a single part configuration or a two-part configuration.

3. The device according to claim 1, wherein the spring leg is comprised, respectively, of a leaf spring (201, 202, 301, 302) bent to a U-shape or of two leaf spring elements (401, 402, 501, 502) which are connected with their free ends to one another in a detachable way.

4. The device according to claim 1, wherein the spring system can be fixedly locked on the lifting platform and is arranged so as to be adjustable on the support frame.

5. The device according to claim 1, wherein the lifting platform is comprised of two lifting platform elements (3*a*, 3*b*) which can be driven in an oscillating fashion by means of a drive device (4*a*, 4*b*), respectively, and wherein the two lifting platform elements are arranged spaced apart from one another receive the continuous casting mold (13) such that it extends between them and the strand is removed between the two lifting platform elements (3*a*, 3*b*), and in that the support frame is also comprised of two support frame elements (2*a*, 2*b*) for receiving a lifting platform element, respectively.

6. The device according to claim 5, wherein a lifting platform element (3*a*, 3*b*), respectively, is provided with four spring systems (61*a* to 64*a*; 61*b* to 64*b*) for load balancing, wherein a foot area of the lifting platform element (33*a*, 33*b*) rests by means of two connecting elements (71*a*, 72*a*, 71*b*, 72*b*) on two spring systems and the lifting platform element is provided at the head end with two projections (81*a*, 82*a*) which rest on the two other spring systems, wherein the spring systems are arranged staggered to one another.

* * * * *